US009643811B2

(12) United States Patent
Farlotti

(10) Patent No.: US 9,643,811 B2
(45) Date of Patent: May 9, 2017

(54) LOOP FOLDING SYSTEM FOR PROVIDING C, Z OR HALF-FOLD SHEETS

(71) Applicant: NEOPOST TECHNOLOGIES, Bagneux (FR)

(72) Inventor: Laurent Farlotti, Arcueil (FR)

(73) Assignee: Neopost Technologies, Bagneux (FR)

( * ) Notice: Subject to any disclaimer, the term of this patent is extended or adjusted under 35 U.S.C. 154(b) by 698 days.

(21) Appl. No.: 14/108,739

(22) Filed: Dec. 17, 2013

(65) Prior Publication Data

US 2014/0171285 A1 Jun. 19, 2014

(30) Foreign Application Priority Data

Dec. 18, 2012 (EP) ..... 12306612

(51) Int. Cl.
*B65H 45/04* (2006.01)
*B65H 45/18* (2006.01)

(52) U.S. Cl.
CPC ..... *B65H 45/04* (2013.01); *B65H 45/18* (2013.01)

(58) Field of Classification Search
CPC ..... B65H 45/04; B65H 45/14; B65H 45/142–45/148; B65H 45/16–45/162; B65H 45/18; B65H 45/145; B65H 45/167
USPC ..... 493/419, 421, 444, 445
See application file for complete search history.

(56) References Cited

U.S. PATENT DOCUMENTS 4,917,662 A * 4/1990 Gombault ..... B41F 13/60 493/416
5,076,556 A 12/1991 Mandel
5,147,275 A 9/1992 Staniszewski
5,487,718 A * 1/1996 Staniszewski ..... B65H 45/14 493/421
5,769,774 A * 6/1998 Beck ..... B65H 45/148 493/419
6,592,506 B1 7/2003 Lyga
7,699,300 B2 * 4/2010 Iguchi ..... B65H 37/04 270/32

FOREIGN PATENT DOCUMENTS

EP 2 223 879 A1 9/2010

OTHER PUBLICATIONS

European Search Report for EP 12306612.8 dated May 13, 2013.

* cited by examiner

*Primary Examiner* — Stephen F Gerrity
*Assistant Examiner* — Joshua Kotis
(74) *Attorney, Agent, or Firm* — Seed IP Law Group LLP

(57) ABSTRACT

A system for selectively C, Z or half-folding sheet(s) of paper of variable format, comprising: a pocket-like channel (10) with a stop element (12) for defining a paper sheet position and positioning the sheet(s) according to a location of a recipient's address A and a type of fold required; two folding rollers (2, 4) arranged diametrically opposite to each other and forming a folding/nipping area (6); an inducing element (8) movable towards and away from the folding/nipping area for defining a fold line position; and a curved guiding path (14, 16, 18, 20, 22, 24, 26) which substantially covers at least one of the two folding rollers for receiving and guiding the sheet(s) completely around one or the other of the two folding rollers without changing their rotational direction during the folding cycle.

17 Claims, 6 Drawing Sheets

FIG.2
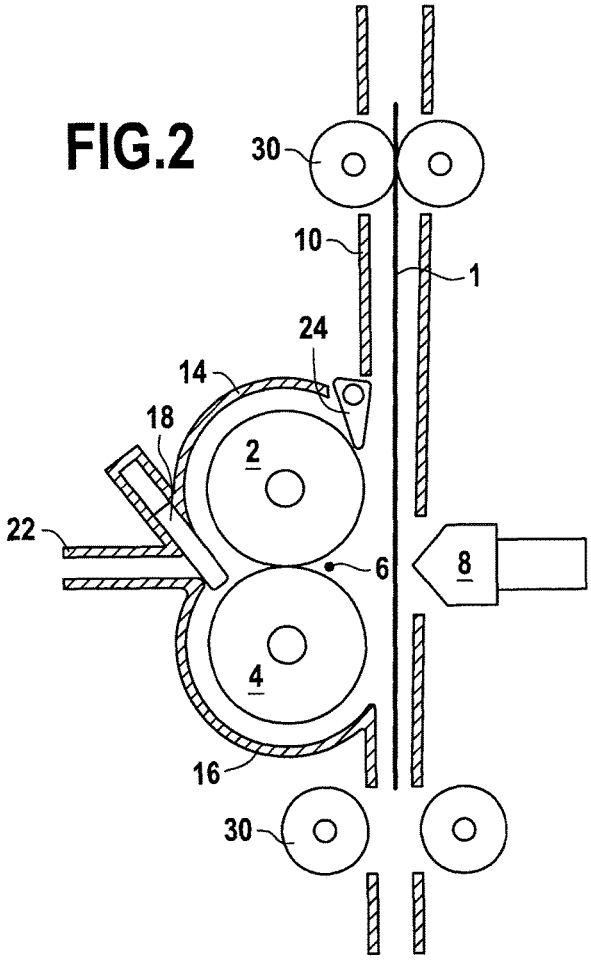
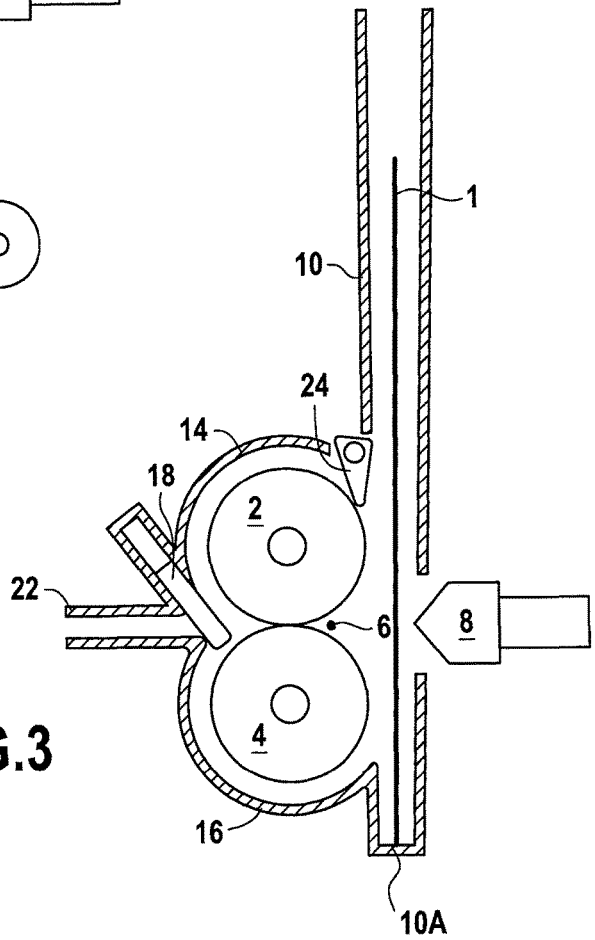
FIG.3

FIG.6
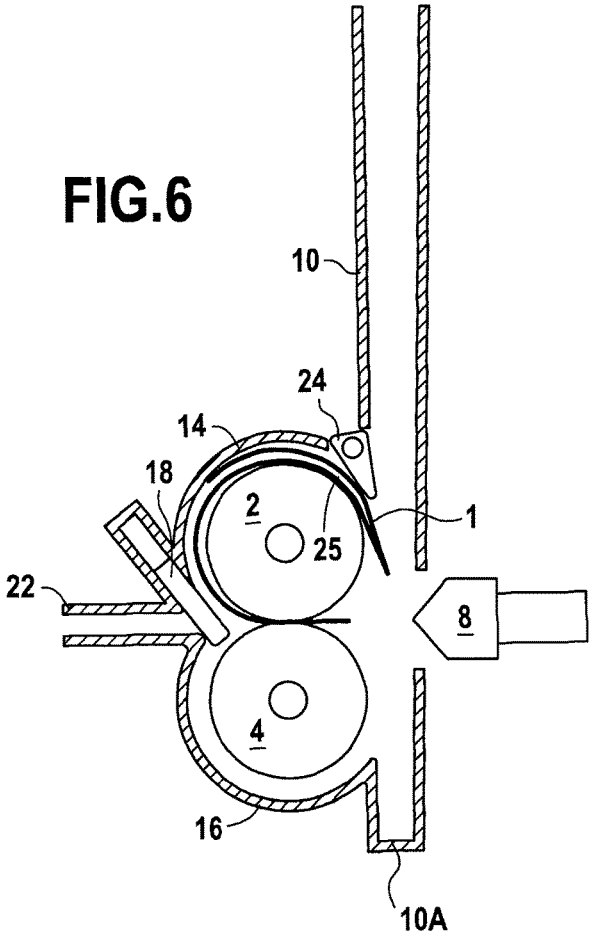
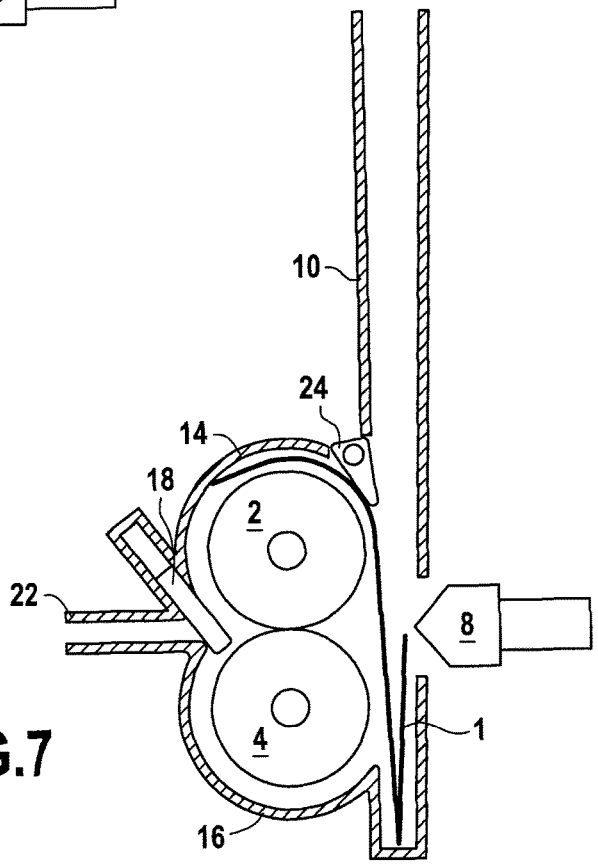
FIG.7

FIG.8
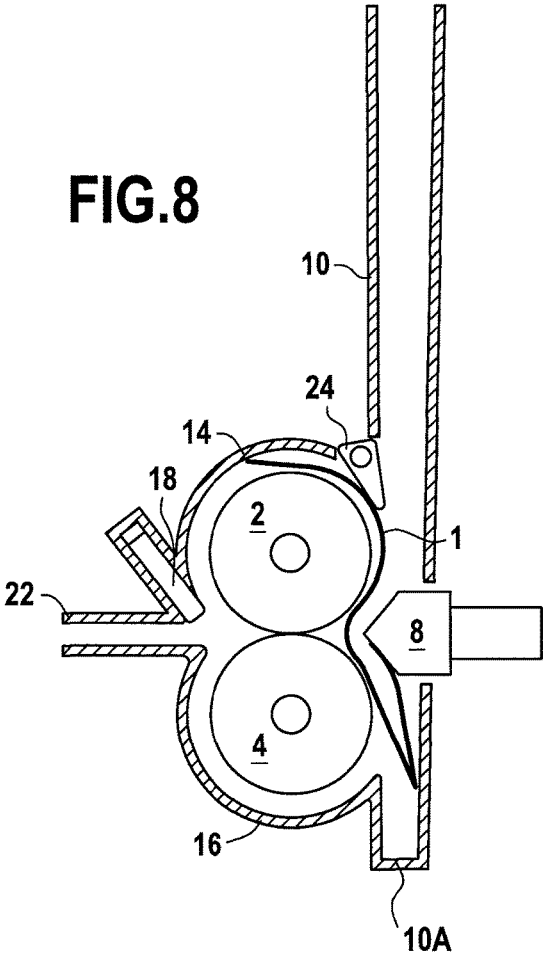
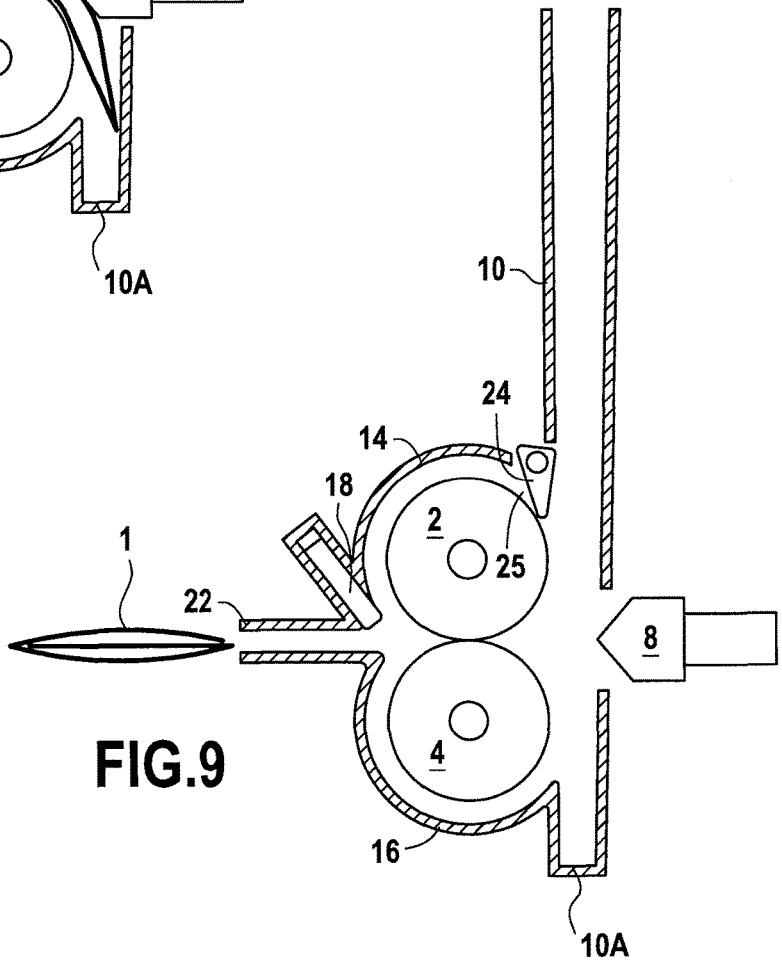
FIG.9

LOOP FOLDING SYSTEM FOR PROVIDING C, Z OR HALF-FOLD SHEETS

CROSS-REFERENCE TO RELATED APPLICATION

This application relates to and claims the benefit of priority from European Patent Application number 12306612.8, filed on Dec. 18, 2012 the entire disclosure of which is incorporated herein by reference.

TECHNICAL FIELD

The present invention relates to the field of folding/inserting, and more specifically to a system for folding single or multiple paper sheets in a C-fold, Z-fold or half-fold configuration.

PRIOR ART

Many folder/inserters use opposite folding rollers. The paper set is transported in front of one pair of rollers, pushed through them by a knife, and a fold is formed when the folding rollers are rotated. A single pair of rollers is enough when a single fold is required. However when several folds are required, a second pair of rollers is commonly used, the first pair forming the first fold and the second forming the second fold. Furthermore a third pair of rollers might be added when several types of fold are required. Usually, rollers can be combined to form several pairs so that a combination of three or four adjacent rollers is necessary to perform the various types of fold.

Folding rollers are an important part of the cost of the folder/inserter because they must satisfy many requirements. Their geometry must be accurate enough so that the set is not deviated when being folded, which would result in a paper jam. Adversely, the material shall be soft enough to accept paper of variable thickness or multiple sheets, yet resist to several dozens of thousands of cycles as can expected for even relatively low range inserters. It is therefore interesting to reduce the number and thus the cost of folding rollers in a folder/inserter.

Folding systems having at least two folding rollers are well known, and in particular the following references:

U.S. Pat. No. 5,076,556 discloses a sheet folding apparatus including a fold position controlling chamber; two fold producing rollers contacting each other at peripheral surfaces thereof and located adjacent one end of the fold position controlling chamber for withdrawing a sheet from the fold position controlling chamber and placing a fold therein; and a recirculation passage extending around the periphery of one of the fold producing rollers so that a sheet can be conveyed around the outer periphery thereof and be inserted back into the fold position controlling chamber. This structure permits one or more folds to be placed in sheet material while requiring only a single fold position controlling chamber and one pair of fold producing rollers.

In this folder, the sheet is circulated around one of the folding rollers after forming a first fold, and passed a second time between the folding rollers to form the second fold. The sheet is driven so as to form buckles in front of the nip formed by the folding rollers. The system is capable of folding one single sheet in either Z-fold or half-fold. No means are provided to push the extension of the sheet already folded into the nip when forming the second of a letter fold. In the absence of such means, the sheet is likely to jam because this extension will not be caught properly.

U.S. Pat. No. 5,147,275 discloses an automatic paper folder comprising (a) means for advancing the sheet into said folder apparatus; (b) guide means for guiding the leading edge of said advancing sheet in a path turning back upon itself in a loop, so that said leading edge of said sheet impinges a transverse line in a trailing portion of said sheet; (c) roller means forming a folding nip extending along and adjacent to said line; (d) wherein said advancing means continually advances said leading edge against said line in said trailing portion of said sheet, to force into said folding nip both said leading edge of said sheet and said transverse line in said sheet, and to form a first creased fold in said sheet extending along said transverse line and containing said sheet leading edge; (e) whereby, upon further operation, said leading edge of said sheet remains within and travels with said fold as it passes through said folding nip, and the portion of said sheet extending in a loop between said fold line and said sheet leading edge thereafter passes through said folding nip to form a second creased fold, thereby folding said sheet into said three sections.

In this folder, the leading edge of the sheet is driven so as to act like a knife and push the following part of the sheet between the folding rollers. By construction this folder is only capable of forming a C-fold.

U.S. Pat. No. 6,592,506 presents a folder apparatus comprising a first fold roller and an input idler roller defining a first nip for feeding a sheet along a feed path to a second nip; a second fold roller positioned adjacent to the first fold roller and defining a second nip there between, the second nip for feeding the sheet along a downstream feed path; an inducer comprising a movable body repositionable between at least a first and second position, at least one inducer idler roller positioned on the body and in a first position forming a nip between the second fold roller and the at least one inducer idler roller, and a blade positioned adjacent to the at least one inducer idler roller and defining a portion of the feed path adjacent to the first fold roller when the inducer is in the first position; whereby when the inducer is in a second position an auxiliary feed path is formed and whereby the sheet may travel along the auxiliary feed path and subsequently be buckled by the blade when the inducer returns to the first position.

In this folder, the sheet is pushed between the folding rollers by an inducer to form a first fold, pulled back, repositioned in front of the folding rollers at a lower position, and then pushed again to form the second fold. Despite the higher complexity of operation, this folder doesn't seem capable of forming a Z-fold.

Though the above-mentioned folders could provide an appropriate response to the economic issue with only two folding rollers, they could still be improved for addressing the additional issues of flexibility, multi-sheet capability and enhanced simplicity.

SUMMARY OF THE INVENTION

The present invention thus aims to eliminate the above drawbacks and to propose a method and apparatus as simple and efficient as possible with such improvements. Its main object consists in proposing a flexible system with a single pair of folding rollers that is capable of folding single or multiple paper sheets in a C-fold, Z-fold or half-fold configuration.

According to a main feature of the invention, this system for selectively C, Z or half-folding at least one sheet S of paper of variable format, comprises:

a pocket-like channel with a stop element for defining a paper sheet position and positioning said at least one sheet according to a location of a recipient's address A and a type of fold required, two folding rollers arranged diametrically opposite to each other and forming a folding/nipping area, an inducing element movable towards and away from said folding/nipping area for defining a fold line position, and a curved guiding path which substantially covers at least one of said two folding rollers for receiving and guiding said at least one sheet completely around one or the other of said two folding rollers without changing their rotational direction during the folding cycle.

All the above-mentioned essential features provide a flexible loop folding cycle for a remarkable automatic paper folder that remains simple enough, compact, user-friendly and economic. As its folding rollers always keep their rotational direction, the resulting throughput becomes higher and the overall operation smoother.

According to another feature of the invention, one of said two folding rollers has a perimeter comprised between the two thirds of the length of said at least one sheet to be folded and the length of said sheet.

According to another feature of the invention, said two folding rollers have the same diameter.

According to another feature of the invention, said pocket-like channel and said two folding rollers present a vertical arrangement.

According to another feature of the invention, that said curved guiding path comprises a cylindrical housing and at least one deflecting flap at an exit area of said two folding rollers for selectively guiding said at least one sheet inside and outside said cylindrical housing.

According to another feature of the invention, that said curved guiding path further comprises at least one pressure element at a junction of said cylindrical housing with said pocket-like channel.

According to another feature of the invention, that said at least one pressure element comprises a spring-biased flap.

According to another feature of the invention, that said inducing element comprises several triangular teeth which protrude from an inner wall of said pocket-like channel through corresponding slots of this latter.

According to another feature of the invention, that said stop element can be formed of a bottom of said pocket-like channel that is expandable between two end stop positions or of at least one pair of conveying rollers for adjusting both the fold line position and the paper sheet position according to the location of the recipient's address and the type of fold required. The recipient's address can be located at a top, middle or a bottom of said at least one sheet.

BRIEF DESCRIPTION OF THE DRAWINGS

The invention will now be further explained and illustrated in the following description with reference to embodiments of the invention as shown in the accompanying drawings, in which:

FIG. 2 is a schematic representation of a side-elevational view of a second embodiment of a loop folding system according to the invention.

FIGS. 3 to 9 are schematic representations of side-elevational views of the loop folding system according to the invention during a complete running cycle for providing C or half-fold sheets, showing successive positions of these latter.

FIGS. 10 to 13 are schematic representations of four complete running cycles pertaining respectively to:

C-fold with the recipient's address in top position;

Z-fold with the recipient's address in bottom position;

C-fold with the recipient's address in middle position; and

Z-fold with the recipient's address in top position.

DETAILED DESCRIPTION OF EMBODIMENTS

Figure 1:
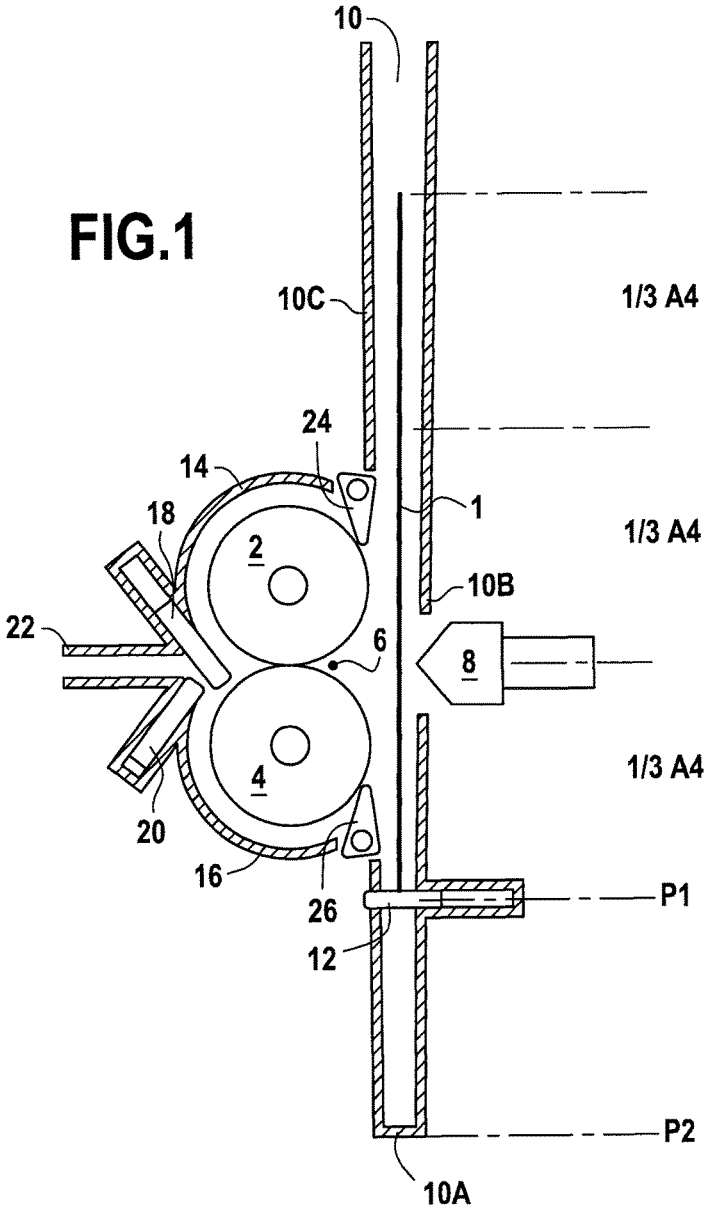
FIG. 1 is a schematic representation of a side-elevational view of a first embodiment of a loop folding system adapted for providing C, Z or half-fold sheets according to the invention.

The loop folding system of the present invention for selectively C, Z or half-folding at least one sheet of paper 1 of variable format is illustrated in FIG. 1.

This system comprises two folding rollers 2, 4 that are arranged diametrically opposite to each other and form a folding/nipping area 6. A movable inducing element 8 used to push the sheet between the rollers towards and away from the folding/nipping area 6 is provided for defining a fold line position to initiate the fold of the sheet(s). The upper folding roller 2 is used as a drive roller to transport the sheet and reposition it when necessary. A pocket-like channel 10 with a stop element 12 is provided for defining a paper sheet position and positioning the sheet (s) according to a location of a recipient's address A and a type of fold required, i.e. C, Z or half-folding. For the understanding of the invention, in FIG. 1, the illustrated paper format is an A4 format and the stop element 12 is located accordingly.

A curved guiding path which substantially covers the two folding rollers 2, 4 defines upstream and downstream access means for receiving and guiding single or assembled paper sheets completely around one or the other of the two folding rollers without changing their rotational direction during the folding cycle.

More specifically, the curved guiding path comprises a cylindrical housing 14, 16, at least one deflecting flap 18, 20 extending parallel to the folding rollers at an exit area 22 of the two folding rollers for selectively guiding the sheet(s) inside and outside the cylindrical housing 14, 16, and at least one pressure element 24, 26 at a junction of the cylindrical housing with the pocket-like channel 10. Preferably, the deflecting flap forms an angle of approximately 45° with respect to the travel direction of the sheet when it is ejected from the folding rollers in the exit area 22 and the pressure element advantageously comprises a spring-biased flap.

The pocket-like channel 10 and the folding rollers 2, 4 are arranged vertically and the sheet(s) to be folded is(are) positioned vertically in front of them. However, they could be positioned at any angle of inclination with reference to the horizontal plane to take sheet(s) from an automatic feeder or a conveyor for example. Indeed, with the pocket-like channel disposed in a roughly horizontal manner, the sheet is less prone to be caught between the folding rollers when re-entering the pocket-like channel.

Depending on the location of stop element 12, a bottom 10A of the pocket like channel can be expandable between two end stop positions P1, P2. In another version, the stop element is formed of at least one pair of conveying rollers 30 that holds the sheet(s) in a desired paper sheet position in the pocket-like channel, as shown on FIG. 2.

Figure 1A:
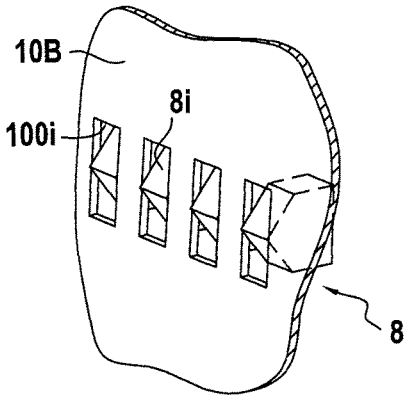
FIG. 1A shows part of the loop folding system of FIG. 1 illustrating an inducing element.

As illustrated on FIG. 1A, the inducing element 8 comprises several triangular teeth 8*i* which protrude from an inner wall 10B of the pocket-like channel through corresponding slots 100*i* of this latter. In another version not claimed it could be a blade that passes through a wide slot of the pocket-like channel 10 which is covered by a pivoting shade.

The folding rollers are disposed on an opposite wall 10C of the pocket-like channel 10 in front of the inducing element 8. In a preferred embodiment, the two folding rollers have the same diameter. Their perimeter is equal or greater than the two thirds of the length of the sheet to prevent the first fold to cross the trailing edge when repositioning the sheet before forming the second fold. Yet the perimeter is smaller than the length of the sheet to ensure that it is always driven until it is repositioned (see FIGS. 5 to 8).

The operation of the folding system described above is now explained in view of FIGS. 3 to 9 as follows.

FIGS. 3 to 9 relate to a C-folding or half-folding cycle with only one deflecting flap 18 and one pressure flap 24 whereas FIG. 1 was a schematic representation of the folding system with two deflecting flaps 18, 20 and two pressure elements 24, 26 for providing C-fold, half-fold or Z-fold paper sheets.

The sheet to be folded is introduced into the pocket-like channel 10 disposed in a roughly vertical arrangement. The leading edge 1A of the sheet A is stopped by the bottom 10A of the pocket so that the inducing element 8 is positioned at approximately the bottom third of the sheet (FIG. 3).

Figure 4:
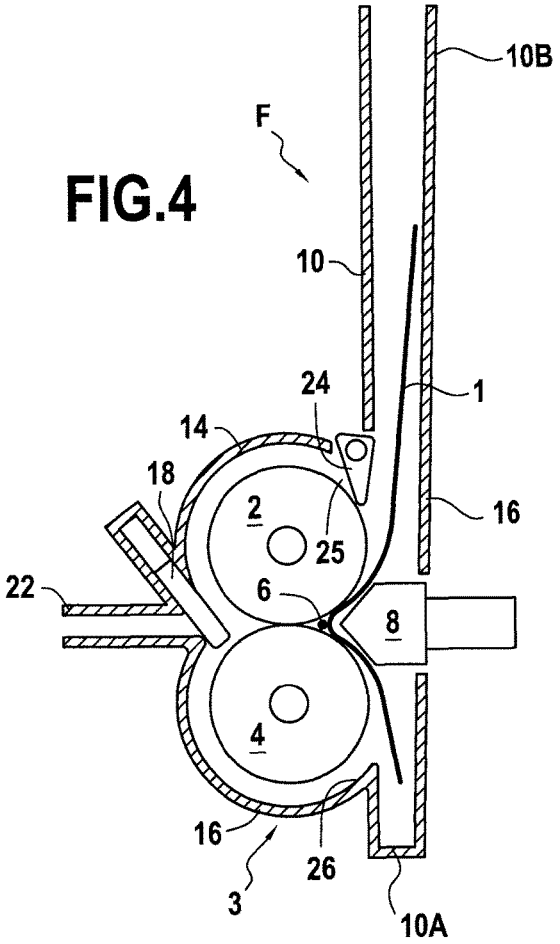

Then, as shown in FIG. 4, the inducing element 8 which has a roughly triangular section allows pushing the extension of the sheet which is already folded so that it will be caught between adjacent sides when forming a C fold. The inner wall 10B extends between the slots 100*i* to guide the sheet when it is first introduced or when it is repositioned by the folding rollers.

Figure 5:
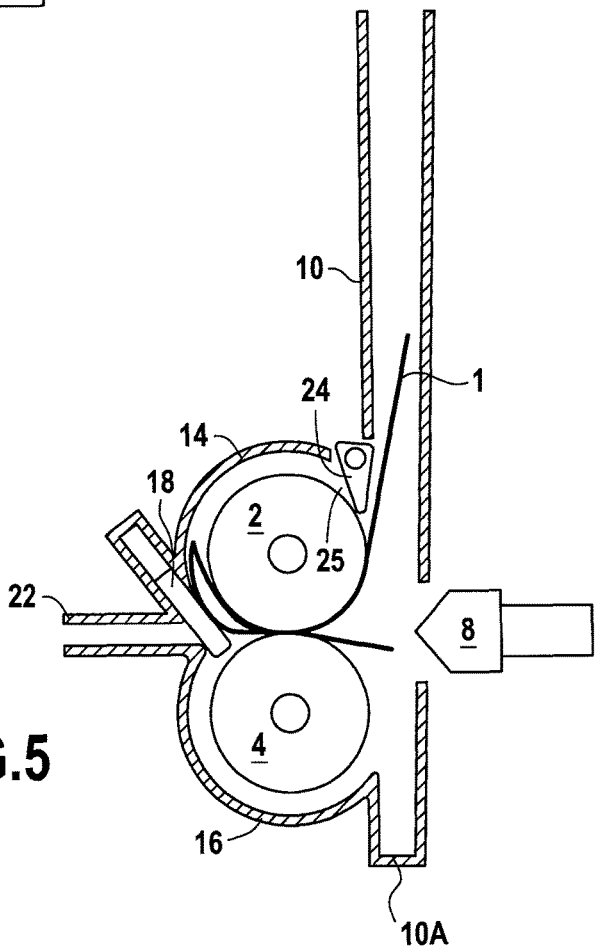

In FIG. 5, when forming the first fold, the sheet is deflected by the deflecting flap 18 and guided around the upper folding roller 2 by the cylindrical guiding housing 14 partially surrounding it and in FIG. 6, the sheet re-enters the pocket-like channel 10 through a slot 25 extending across the inner wall 10C parallel to the folding rollers and recovered by the spring-biased flap 24. This flap is spring-biased to allow the sheet to re-enter the pocket-like channel until it is stopped (FIG. 7) but prevent it from entering the guiding housing 14, 16 when it is first introduced. Additionally, the spring-biased flap 24 keeps the sheet pressed against the driving folding roller 2 until it is repositioned.

When forming the second fold (FIG. 8), the deflecting flap 18 is offset to let the folded sheet go out of the folding system and into an envelope (FIG. 9).

Although the description above represents the preferred embodiment, the present invention is not limited to a single sheet and a single fold type. The inducing element allows folding sets of typically three to five sheets. Moreover the folding system can be enhanced to handle various fold types and address positions.

Depending on the type of fold required and the position of the address, the first fold can be initiated at the lower or upper third of the sheet, and either the upper or the lower folding roller can be used as drive roller. This requires adding a lower deflector flap 20 and a lower spring-biased flap 26 and two stop positions P1, P2 for the sheet as shown in FIG. 1. To initiate the first fold at its upper third, the sheet must be stopped at a second position deeper in the pocket-like channel 10. This is achieved for instance by adjusting the pocket length with an expandable bottom depending on the location of the stop element.

It shall be noted that the stop position may be further adjusted to modify the length of the first fold. In an alternative, the stop position may also be defined by holding rollers 30 as in FIG. 2 above.

Figure 10:
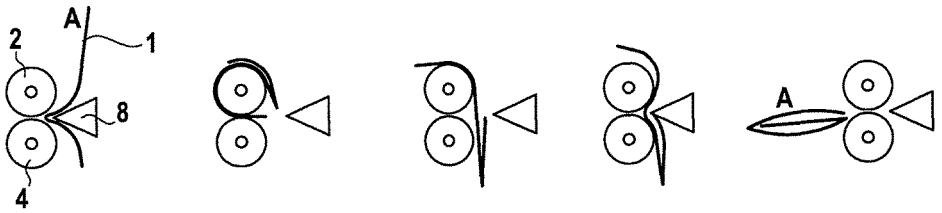

FIG. 10 illustrates a first fold at lower third and sheet deflected upwards will form a C fold with the recipient's address in top position as per the first embodiment, which is the most common requirement.

Figure 11:
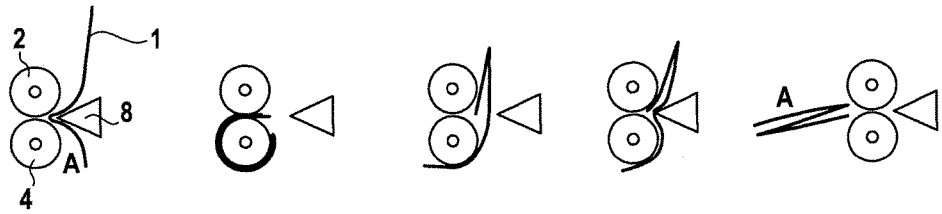

FIG. 11 illustrates a first fold at lower third and sheet deflected downwards will form a Z fold with the recipient's address in bottom position.

Figure 12:
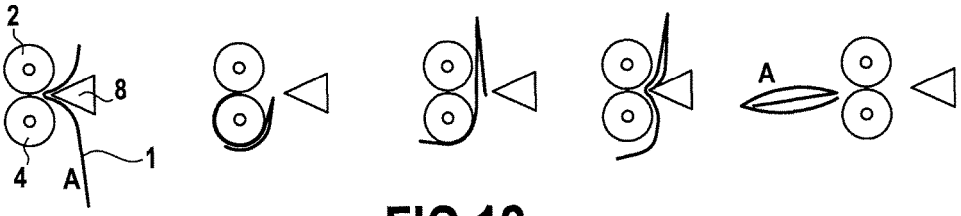

FIG. 12 illustrates a first fold at upper third and sheet deflected downwards will form a C fold with the recipient's address in middle position.

For these combinations, the sheet is positioned with the address facing the folding rollers.

Figure 13:
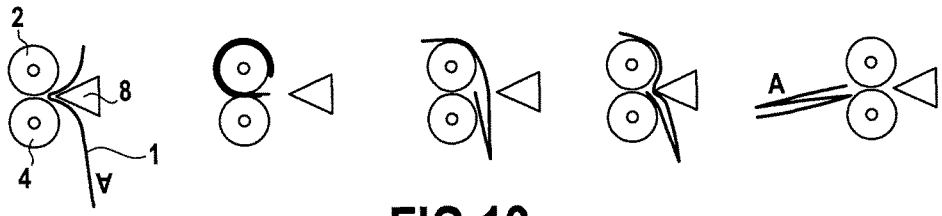

FIG. 13 illustrates a first fold at upper third and sheet deflected upwards will form a Z fold with the recipient's address in top position, but the sheet shall be first positioned upside down with the recipient's address on opposite side.

The loop folding system described automatically selects the programmed operating mode together with the automatic adjustment of the stop and flap positions according to the paper type, the fold type and the location of the recipient's address, and displays the relevant instructions for appropriately positioning the single or assembled sheets of paper within the pocket-like channel.

It shall be noted that the folding rollers always rotate in the same direction, which reduces the risk of paper jam. The movements of the folding rollers, the inducing element and the deflecting flaps can be synchronized to ensure fast and smooth operation of the system.

Additional elements, such as free rollers, can be added without departing from the essential characteristics of the invention. Similarly the spring-biased flaps can be replaced by spring-biased rollers.

Although it is not the main purpose of the invention, the system can also be used to form a half-fold by positioning the middle of the sheet or set in front of the inducing element and passing it only once between the folding rollers.

The invention claimed is:

1. A system for selectively C, Z or half-folding at least one sheet of paper of variable format, comprising:

a pocket channel with a stop element to define a paper sheet position and positioning said at least one sheet according to a location of a recipient's address and a type of fold required, two folding rollers capable of folding the at least one sheet, wherein each roller has a respective diameter, the diameters of the two folding rollers being equal to one another, the two folding rollers arranged diametrically opposite to each other and forming a folding/nipping area, an inducing element movable towards and away from said folding/nipping area to define a fold line position, a cylindrical housing defining a curved guiding path, which substantially covers said two folding rollers, configured to receive and guide said at least one sheet completely around at least one of said two folding rollers during a folding cycle;

wherein the system is capable of performing the folding cycle which is selectable from a C-folding cycle, Z-folding cycle or half-folding cycle; and wherein the two folding rollers rotate without changing their rotational direction during the entirety of any of the different selected folding cycles.

2. The system according to claim 1, characterized in that said two folding rollers have a perimeter comprised between the two thirds of the length of said at least one sheet to be folded and the length of said sheet.

3. The system according to claim 1, characterized in that both said pocket channel and said two folding rollers are arranged vertically.

4. The system according to claim 1, characterized in that said curved guiding path comprises at least one deflecting flap at an exit area of said two folding rollers to selectively guide said at least one sheet inside and outside said cylindrical housing.

5. The system according to claim 4, characterized in that said curved guiding path further comprises at least one pressure element at a junction of said cylindrical housing with said pocket channel.

6. The system according to claim 5, characterized in that said at least one pressure element comprises a spring-biased flap.

7. The system according to claim 1, characterized in that said inducing element comprises several triangular teeth which protrude from an inner wall of said pocket channel through corresponding slots of the pocket channel.

8. The system according to claim 1, characterized in that said stop element is formed of a bottom of said pocket channel, the pocket channel having a length which is adjustable between two end stop positions (P1, P2) to adjust both the fold line position and the paper sheet position according to the location of the recipient's address and the type of fold required.

9. The system according to claim 8, characterized in that said recipient's address is located at a top, middle or a bottom of said at least one sheet.

10. The system according to claim 1, characterized in that said stop element is formed of at least one pair of conveying rollers operable to adjust both the fold line position and the paper sheet position according to the location of the recipient's address and the type of fold required.

11. The system according to claim 1 wherein said inducer is a blade with several triangular teeth which protrude from an inner wall of the pocket channel through corresponding slots of the pocket channel.

12. The system according to claim 1 wherein a second stop comprises at least one pair of conveying rollers, rotation of which is selectively operable based on the location of the recipient's address and the type of fold to be made to the length of travel of the at least one sheet along the pocket channel.

13. A system for selectively C, Z or half-folding at least one sheet of variable format, comprising:

a channel having a proximal end and a distal end, the channel sized to receive the at least one sheet via the proximal end of the channel;

a first stop positioned at a distal end of the channel to limit a length of travel of the at least one sheet along the channel to position the at least one sheet at a first location;

a second stop that is selectively deployable with respect to the channel at a position between the proximate end and the first stop to selectively limit the length of travel of the at least one sheet along the channel to position the at least one sheet at a second location based on a recipient's address and a type of fold required;

two of folding rollers capable of folding the at least one sheet, wherein each roller has a respective diameter, the diameters of the two folding rollers being equal to one another, the two folding rollers arranged diametrically opposite to each other and forming a folding/nipping area, the folding/nipping area accessible from the channel;

an inducer selectively movable towards and away from said folding rollers through the folding/nipping area to define a fold line position in the at least one sheet and to selectively move the at least one sheet into engagement with the two folding rollers;

a cylindrical housing defining a curved guiding path, which at least partially covers said two folding rollers, configured to receive and guide said at least one sheet completely around one or the other of said two folding rollers during a folding cycle;

wherein the system is capable of performing the folding cycle which is selectable from a C-folding cycle, Z-folding cycle or half-folding cycle; and wherein the two folding rollers rotate without changing their rotational direction during the entirety of any of the different selected folding cycles.

14. The system according to claim 13 wherein said two folding rollers have a perimeter having a respective length that is between two thirds of a length of said at least one sheet to be folded and a length of said sheet.

15. The system according to claim 13 wherein said curved guide path comprises a cylindrical housing and at least one deflecting flap positioned at least proximate an exit area of said two folding rollers to selectively guide said at least one sheet inside and outside said cylindrical housing.

16. The system according to claim 15 wherein said curved guide path further comprises at least one selectively deployable flap at a junction of said cylindrical housing with said channel.

17. The system according to claim 16, characterized in that said at least one selectively deployable flap comprises a spring-biased flap.

* * * * *